US007740377B1

(12) United States Patent
Thomas

(10) Patent No.: US 7,740,377 B1
(45) Date of Patent: Jun. 22, 2010

(54) HOLIDAY TREE ORNAMENT HAVING SMOKE ALARM

(76) Inventor: George Thomas, 2214 Wantagh Ave., Wantagh, NY (US) 11793

( * ) Notice: Subject to any disclaimer, the term of this patent is extended or adjusted under 35 U.S.C. 154(b) by 194 days.

(21) Appl. No.: 12/036,833

(22) Filed: Feb. 25, 2008

(51) Int. Cl.
*F21V 21/00* (2006.01)

(52) U.S. Cl. ..... 362/249.17; 362/121; 340/628

(58) Field of Classification Search ..... 362/86, 362/121, 122, 123, 249.06, 249.14, 249.16–19, 362/253; 340/628, 594, 584
See application file for complete search history.

(56) References Cited

U.S. PATENT DOCUMENTS 4,075,614 A * 2/1978 White ..... 340/594
4,339,787 A * 7/1982 Burnbaum ..... 362/121
4,623,878 A 11/1986 Schoenwetter
5,396,221 A * 3/1995 Bridges ..... 340/628
5,821,865 A 10/1998 Solak
5,880,676 A 3/1999 Tsou

* cited by examiner

*Primary Examiner*—Gunyoung T Lee
(74) *Attorney, Agent, or Firm*—Crossley Patent Law; Mark A. Crossley

(57) ABSTRACT

A holiday tree ornament that incorporates a number of internal lights along with a smoke alarm that is connected to a power source is disclosed. The holiday tree ornament includes an outer housing, which is hollow, and a cover that can be placed atop the housing. The outer housing is fabricated from a base and a plurality of walls, with the outer housing preferably having the shape of a star. Within the outer housing is located a plurality of lights that are connected via lengths of wiring. In addition, a smoke alarm is connected to the wiring. A number of air holes are located on the base to ensure free air flow from the outside air to the air within the holiday tree ornament. The lights and the smoke alarm are connected to a power source, which preferably is standard household current.

6 Claims, 3 Drawing Sheets

HOLIDAY TREE ORNAMENT HAVING SMOKE ALARM

BACKGROUND OF THE INVENTION

The present invention concerns that of a new and improved holiday tree ornament that incorporates a number of internal lights along with a smoke alarm that is connected to a power source.

DESCRIPTION OF THE PRIOR ART

U.S. Pat. No. 4,075,614, issued to White, discloses a fire detector and alarm, along with means to mount it on a Christmas tree.

U.S. Pat. No. 5,880,676, issued to Tsou, discloses a Christmas tree ornament-shaped fire alarm which includes a housing shaped as a Christmas ornament and has an interior space.

U.S. Pat. No. 5,396,221, issued to Bridges, discloses a smoke alarm that is disguised as a Christmas tree ornament.

U.S. Pat. No. 5,821,865, issued to Solak, discloses a smoke/heat detector that is in the form of a Christmas tree ornament and utilizes a spherical ornament housing divided by a fire-resistant barrier into lower and upper chambers.

U.S. Pat. No. 4,623,878, issued to Schoenwetter, discloses a smoke alarm mounted atop a Christmas tree, where an early indication of an impending fire may be generated.

SUMMARY OF THE INVENTION

The present invention concerns that of a new and improved holiday tree ornament that incorporates a number of internal lights along with a smoke alarm that is connected to a power source. The holiday tree ornament includes an outer housing, which is hollow, and a cover that can be placed atop the housing. The outer housing is fabricated from a base and a plurality of walls, with the outer housing preferably having the shape of a star. Within the outer housing is located a plurality of lights that are connected via lengths of wiring. In addition, a smoke alarm is connected to the wiring. A number of air holes are located on the base to ensure free air flow from the outside air to the air within the holiday tree ornament. The lights and the smoke alarm are connected to a power source, which preferably is standard household current.

There has thus been outlined, rather broadly, the more important features of an holiday tree ornament that the detailed description thereof that follows may be better understood and in order that the present contribution to the art may be better appreciated. There are, of course, additional features of the holiday tree ornament that will be described hereinafter and which will form the subject matter of the claims appended hereto.

In this respect, before explaining at least one embodiment of the holiday tree ornament in detail, it is to be understood that the holiday tree ornament is not limited in its application to the details of construction and to the arrangements of the components set forth in the following description or illustrated in the drawings. The holiday tree ornament is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present holiday tree ornament. It is important, therefore, that the claims be regarded as including such equivalent constructions insofar as they do not depart from the spirit and scope of the present invention.

It is therefore an object of the present invention to provide a holiday tree ornament which has all of the advantages of the prior art and none of the disadvantages.

It is another object of the present invention to provide a holiday tree ornament which may be easily and efficiently manufactured and marketed.

It is another object of the present invention to provide a holiday tree ornament which is of durable and reliable construction.

It is yet another object of the present invention to provide a holiday tree ornament which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
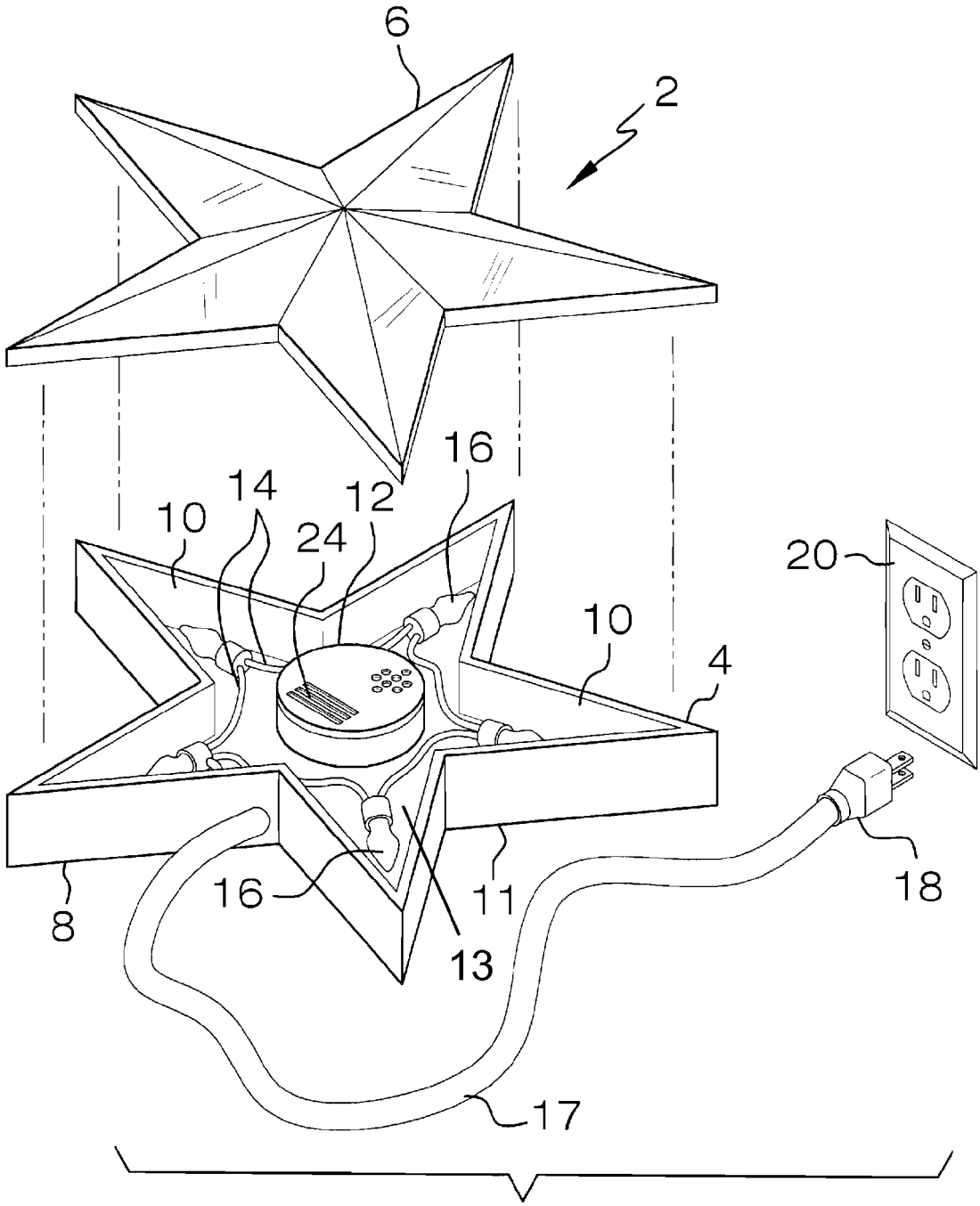
FIG. 1 shows a perspective view of the housing of the holiday tree ornament, along with the cover for the housing, after the cover has been removed from the housing.
Figure 2:
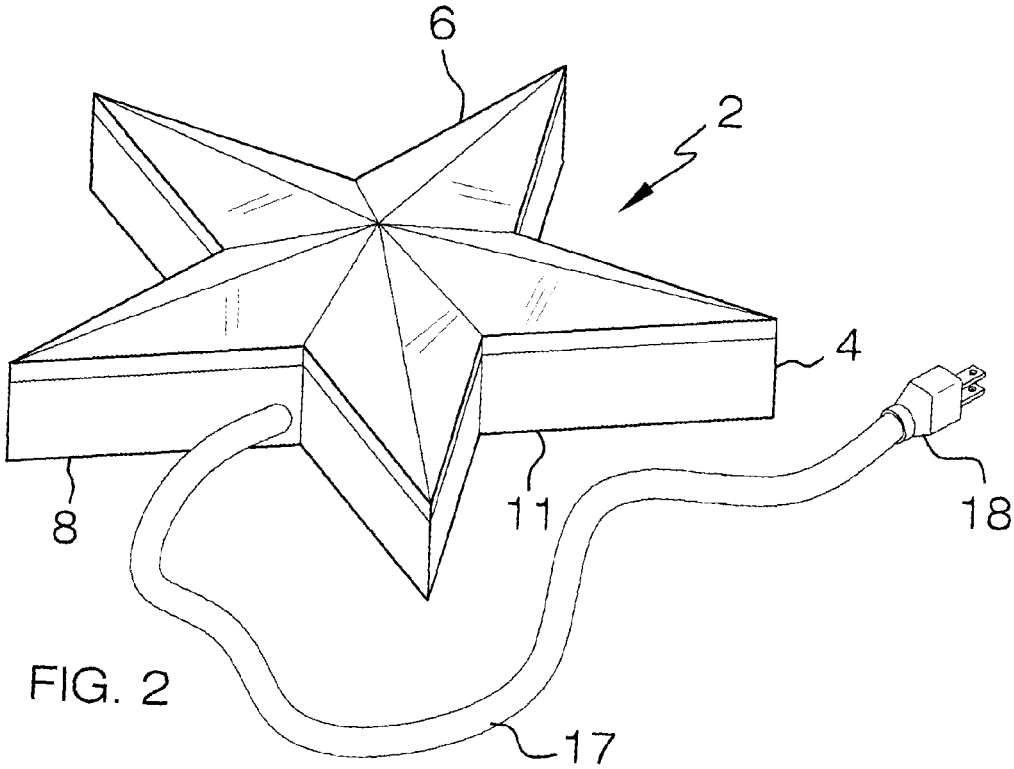
FIG. 2 shows a perspective view of the housing of the holiday tree ornament, along with the cover for the housing, after the cover has been placed on the housing.
Figure 3:
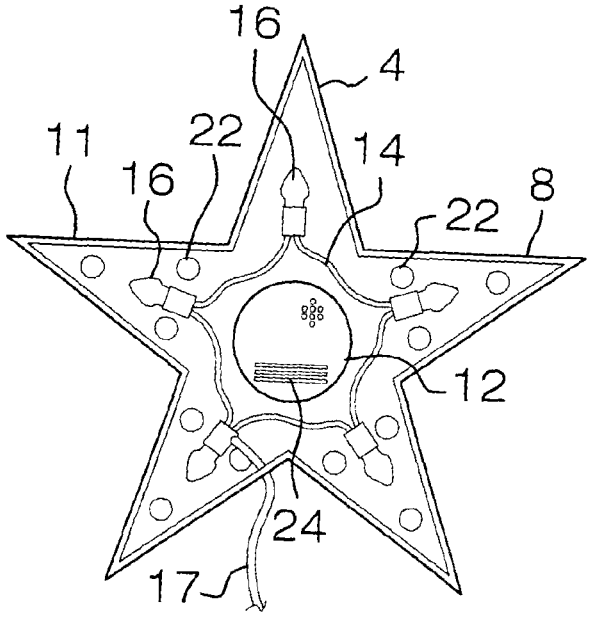
FIG. 3 shows a top view of the holiday tree ornament after the cover has been removed from the housing.
Figure 4:
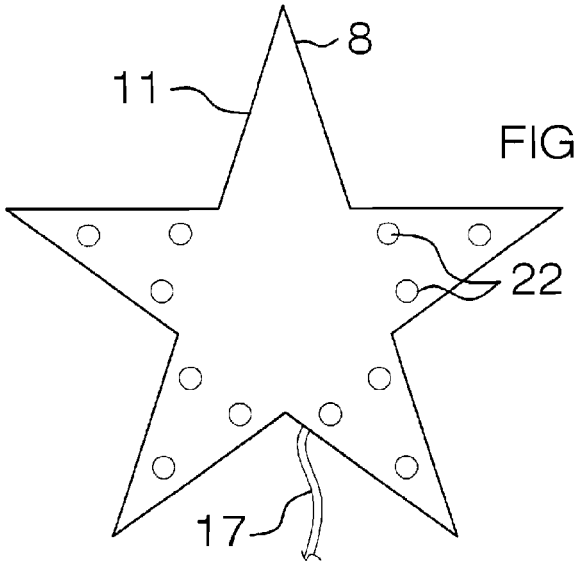
FIG. 4 shows a bottom view of the holiday tree ornament.
Figure 5:
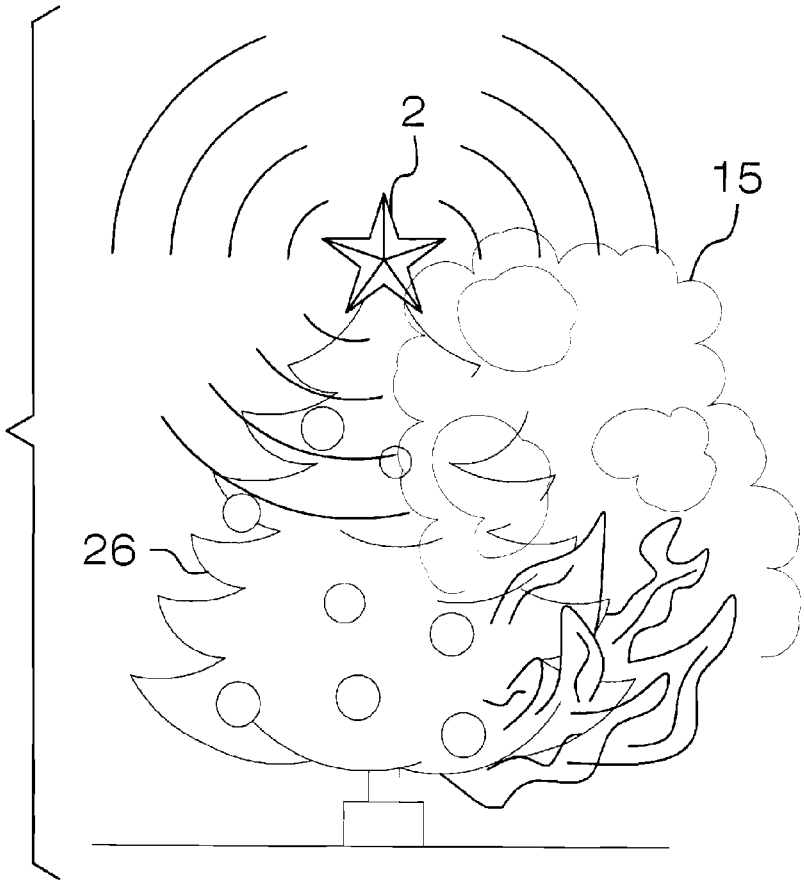
FIG. 5 shows a side view of the holiday tree ornament as it would appear in use on a holiday tree.

With reference now to the drawings, and in particular to FIGS. 1 through 5 thereof, a new holiday tree ornament embodying the principles and concepts of the present invention and generally designated by the reference numeral 2 will be described.

As best illustrated in FIGS. 1 through 5, the holiday tree ornament 2 comprises an outer housing 4. The outer housing 4 comprises a base 8 that has two surfaces, a top surface and a bottom surface. Furthermore, the outer housing has a perimeter 11. The outer housing 4 further comprises a plurality of walls 10, which are attached to the top surface of the base around the perimeter 11 of the base 8. The base 8 also includes an interior cavity 13 therein, the interior cavity 13 defined by the top surface, the bottom surface, and the walls 10.

The outer housing 4 is hollow, with an open area being defined within the plurality of walls 10 immediately above the top surface of the base 8. The base 8 is preferably star-shaped, but can have other various shapes as well.

Located within the outer housing 4 is a smoke alarm 12, which is preferably centrally mounted on the top surface of the base 8. The smoke alarm 12 further comprises a plurality of vents 24 through which the smoke alarm 12 can detect smoke 15. The smoke alarm 12 is preferably powered by power means 17, which preferably is a standard electrical plug 18 that is connected to a wall outlet 20.

The holiday tree ornament 2 further comprises a plurality of bulbs 16 that are mounted on the top surface of the base 8 and are located within the outer housing 4. The bulbs 16 are connected to one another and to the power means 17 via wiring 14.

The holiday tree ornament 2 further comprises a cover 6 that can be placed over the plurality of walls 10 that are attached to the base 8 of the housing 4. The cover 6 preferably has the same shape as the base 8 so as to completely cover up the smoke alarm 12 and the bulbs 16 within the housing 4. The cover 6, once placed over the plurality of walls 10, acts as a closed top that completely covers the smoke alarm 12 and the bulbs 16. The smoke alarm 12 is completely contained within the interior cavity 13 of the base 8 and the cover 6.

The holiday tree ornament 2 further comprises a plurality of air holes 22 interspersed on it. The air holes 22 do not have to a particular pattern, but there does need to be at least several of them on the base 8. The presence of the air holes 22 will allow any smoke 15 present in the outside air to eventually enter the hollow area within the housing 4 and trigger the smoke alarm 12, which would then make noise and notify an individual of the presence of smoke 15.

In use, the holiday tree ornament 2 is preferably placed on a holiday tree, due to the fact that holiday trees (primarily real ones that have been cut and then placed in an indoor setting) become fire hazards due to the fact they begin to dry out over time. The presence of the holiday tree ornament 2 on the holiday tree 26 will provide an extra added safety measure within residences, as the proximity of the holiday tree ornament 2 and the holiday tree 26 are much closer than an already-existing smoke alarm would be within a residence.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A holiday tree ornament in
combination with a holiday tree, the holiday tree ornament comprising:
a base having a top surface, a bottom surface and a perimeter;
a plurality of walls attached to the top surface of the perimeter of the base;
a cover removably attached to the walls;
an interior cavity disposed within the base, the interior cavity defined by the top surface, the bottom surface, and the walls;
an alarm system attached to the top surface of the base;
power means to provide power to the alarm system and the lighting system;
wherein the holiday tree ornament is removably mounted on a holiday tree;
wherein the holiday tree ornament further comprises a lighting system attached to the top surface of the base, wherein the lighting system is attached to the power means;
wherein the base is star-shaped;
wherein the holiday tree ornament further comprises a plurality of holes, the plurality of holes being interspersed on the base;
wherein the alarm system attached to the top surface of the base further comprises
a smoke alarm attached to the top surface of the base, the smoke alarm completely contained within the interior cavity of the base and the cover;
a plurality of air holes located in the smoke alarm;
wherein the smoke alarm is designed to emit an audible alarm when the smoke alarm detects smoke; and
further wherein the smoke alarm is connected to the power means.

2. A holiday tree ornament according to claim 1 wherein the lighting system attached to the top surface of the base further comprises
(a) a plurality of bulbs attached to the top surface of the base,
(b) wiring to interconnect the bulbs to one another,
(c) wherein the wiring is also connected to the power means.

3. A holiday tree ornament according to claim 2 wherein the power means further comprises standard household current.

4. A holiday tree ornament according to claim 3 wherein the holiday tree ornament further comprises a cover, the cover designed to be placed over the plurality of walls.

5. A holiday tree ornament according to claim 4 wherein the cover has the same shape as that of the base.

6. A holiday tree ornament according to claim 5 wherein the cover completely envelops the smoke alarm and the plurality of lights once placed on top of the plurality of walls.

* * * * *